US007045043B1

(12) United States Patent
Kim et al.

(10) Patent No.: US 7,045,043 B1
(45) Date of Patent: May 16, 2006

(54) METHOD OF REDUCING A BAND MARK OF AN ELECTROPLATING STEEL SHEET

(75) Inventors: Hyung-Jun Kim, Pohang-si (KR); Shi-Yeob Lee, Pohang (KR)

(73) Assignee: Pohang Iron and Steel Co., Ltd., (KR)

( * ) Notice: Subject to any disclaimer, the term of this patent is extended or adjusted under 35 U.S.C. 154(b) by 506 days.

(21) Appl. No.: 10/089,125

(22) PCT Filed: Jul. 24, 2000

(86) PCT No.: PCT/KR00/00792

§ 371 (c)(1),
(2), (4) Date: Feb. 12, 2003

(87) PCT Pub. No.: WO02/12595

PCT Pub. Date: Feb. 14, 2002

(51) Int. Cl.
*C25B 9/00* (2006.01)

(52) U.S. Cl. ..... 204/279; 204/199; 204/206; 205/93; 205/137; 205/152

(58) Field of Classification Search ..... 204/199, 204/206, 279; 205/93, 137, 152
See application file for complete search history.

(56) References Cited

U.S. PATENT DOCUMENTS

| | | | | |
|---|---|---|---|---|
| 4,772,361 | A * | 9/1988 | Dorsett et al. | 205/93 |
| 4,849,083 | A * | 7/1989 | Bertrand et al. | 204/206 |
| 4,949,445 | A * | 8/1990 | Van Der Meulen et al. | 492/15 |
| 5,939,677 | A * | 8/1999 | Ko | 174/68.1 |
| 6,024,849 | A * | 2/2000 | Ko | 204/279 |

* cited by examiner

*Primary Examiner*—Bruce F. Bell
(74) *Attorney, Agent, or Firm*—Steven L. Nichols; Rader, Fishman & Grauer PLLC

(57) ABSTRACT

The present invention relates to a method of reducing a band mark on an electroplating steel sheet, which can also reduce plating defects and damages to the materials caused by the differences in the physical characteristics of composition materials of a conductor roll used during electroplating Zn or Ni onto a steel sheet. In other words, the present invention comprises ceramic coating portions of circular bands, placed respectively in a thin strip at the both edge regions of the metal band position at the central portion of a conductor roll. In this manner, the present invention has the effects of reducing a band mark on a plating steel sheet, and also suppressing the generation of static electricity by eliminating the level difference between the conductive material (metal band portion) and the non-conductive material (rubber section). The present invention is also cabaple extending the life of a conductor roll by enhancing the wear and corrosion resistances thereof.

22 Claims, 3 Drawing Sheets

METHOD OF REDUCING A BAND MARK OF AN ELECTROPLATING STEEL SHEET

TECHNICAL FIELD

The present invention relates to a method of reducing a band mark on an electroplating steel sheet, for enhancing wear and corrosion resistances of a conductor roll, which comprises minimizing the level difference between the conductive material (metal band portion) and the non-conductive material (rubber section) of the conductor roll used during the process of electroplating zinc (Zn) or nickel (Ni) onto the steel sheet.

BACKGROUND ART

In general, a conductor roll (1) is an electric apparatus for plating a steel sheet, installed in electrolytic bath, which is immersed into the plating solution (L) with Zinc (Zn) or Nickel (Ni) as an anode, and the conductor roll itself as a cathode. By continuously inducing a steel sheet (S) in this manner, the conductor roll carries out electroplating as illustrated in FIG. 1.

Here, with respect to the conductor roll (1), if the entire portion of its surface consists of a conductive material, the roll itself becomes electroplated. As such, in order to plate the steel sheet while not plating the conductor roll in itself, the conductor roll (1) which is in direct contact with the steel sheet (S) is made out of a non-conductive material at the outer sections (d) of the conductor roll (i.e., both end portions of the cylinder).

In other words, as illustrated in FIG. 2, a conductor roll (1) comprises an inner section (D) in the central portion of the cylinder, and an outer section (d) at the either end portion of said inner section (D). The inner section (D) comprises a conductive material, such as steel or a metal material, having superior acid and corrosion resistances in a strongly acidic plating solution. The outer section (d) comprises a non-conductive material such as rubber. Meanwhile, the width of the conductive metal material at the inner section (D) of the conductor roll (1) should be less than the minimal width of the steel sheet (S) to be plated (i.e., generally lesser by 100 mm).

On the other hand, Japanese Patent No. 10,245,695 (Sep. 14, 1998), as a means of enhancing corrosion and wear resistances of a conductor roll, teaches a method of spray-coating the steel band portion with a mixture of nickel-based alloy and tungsten carbide (WC). Meanwhile, Japanese Patent No. 4,346,693 (Dec. 2, 1992) teaches a method of enhancing corrosion and wear resistances by coating the cobalt or nickel-based alloy with ceramics of relatively superior electric conductivity (to the degree of carbides).

Moreover, as for the non-conductive material used in the outer section (d), which comprises the both end portions of the conductor roll (1), ebonite (i.e., polymer materials), multilastic, sponge, polyurethane, etc. are used.

Moreover, as for the plating solution for immersing the conductor roll (1) during the electroplating process, the temperature used therein is approximately 70° C. Due to the differences in the mutual thermal expansion coefficients as between the metal band portion (3) of the inner section (D) and the rubber section (4) of the outer section (d) at the temperature of the plating solution in use, the rubber section (4) is characterized by greater expansion as compared to the metal band portion (3).

Therefore, in consideration of the thermal expansion coefficient of the metal band portion (3) of the conductor roll (1) and that of the rubber section (4), the level difference (h) of the rubber section (4) is made in such a manner to be lower than the level difference of the metal band portion (3). In this manner, the level of the metal band portion (3) of the inner section (D) and that of the rubber section (4) of the outer section (d) are maintained at a certain level at the temperature of plating solution in use (approximately 70° C.).

However, if the deflector roll (2), which pulls the plating metal sheet (S) in both directions, applies tension via the conductor roll (1), the plating metal sheet presses against the rubber section (4), which in turn results in deformation of the rubber section (4). In particular, depending on the quality of the material, the thickness thereof, and the degree of tension therein, the extent to which it presses against the rubber section (4) may vary.

In other words, as shown in FIG. 2, as the load of the plating steel sheet (2) becomes directly concentrated on the ends of the metal band portion (3), it induces a curve deformation (W), more severe than the level difference thereof (h). Consequently, a strip is formed (i.e., band mark) on the surface of the steel sheet (S) passing under the curve deformation region (W). This type of a band mark could be clearly confirmed with the naked eye and is one of the most severe defects of the plating steel sheet.

If the level difference (h) between the metal band portion (3) and the rubber section (4) is made to be smaller in order to reduce the band mark on a steel sheet (S), the load of the steel sheet becomes concentrated on the rubber section, and the frequency of occurrence of band marks is decreased. However, a gap is created between the conductive metal band portion and the plating steel sheet. Consequently, as shown in FIG. 4(*a*), static electricity (arc) is created therein.

Moreover, if static electricity is generated between the metal band portion and the plating steel plate, the metal band portion and the rubber section rapidly become damaged by static electricity. When this type of situation occurs, an abrasion work on the conductor roll must be immediately carried out once again.

Consequently, if the level difference (h) between the metal band portion (3) and the rubber section (4) is made to be smaller, the frequency of occurrence of band marks is reduced although there is a problem associated with the reduction of life of the conductor roll due to the premature damage to the metal band portion and the rubber section.

In this regard, in consideration of these problems caused by the aforementioned structural defects of a conductor roll, the present invention was devised with an objective of providing a means of eliminating a band mark on a steel sheet, which uses a non-conductive ceramic material, instead of a polymer material with a large thermal expansion coefficient.

In achieving the aforementioned objective, the present invention comprises ceramic coating portions of circular bands, placed respectively in a thin strip at the both edge regions of the metal band portion at the central portion of a conductor roll. As such, the present invention has the effects of suppressing the occurrence of static electricity and also reducing a band mark on an electroplating steel sheet by eliminating the level difference between the conductive material (metal band portion) and the non-conductive material (rubber section) thereof. Furthermore, the present inven tion is capable of extending the life of a conductor roll by enhancing the wear and corrosion resistances thereof.

DISCLOSURE OF INVENTION

Figure 1:
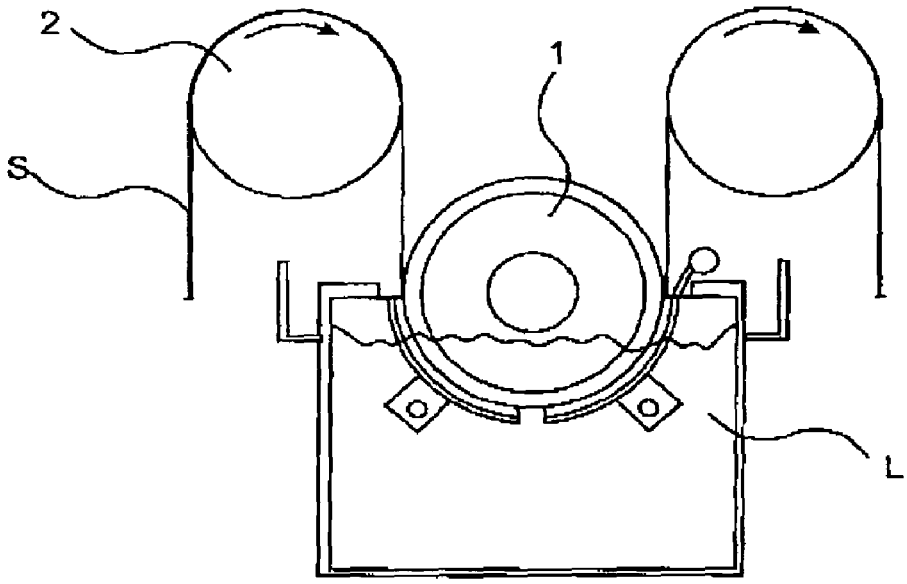
FIG. 1 (Prior Art)
FIG. 1 is a sectional structural diagram of a general electroplating conductor roll as installed.
Figure 2:
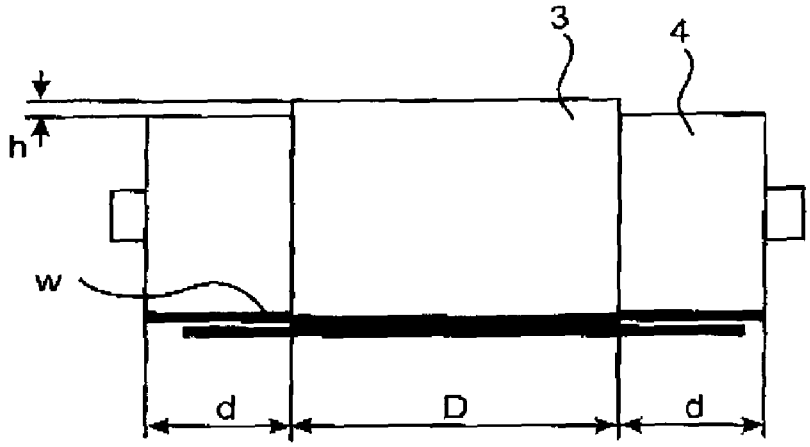
FIG. 2 (Prior Art)
FIG. 2 is a lateral structural diagram of a conventional conductor roll.
Figure 3:
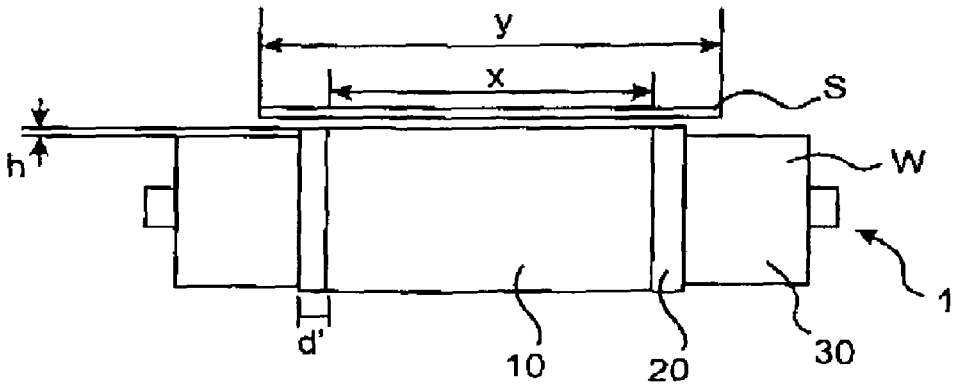
FIG. 3 is a structural diagram of a conductor roll for reducing a band mark according to the embodiment of the present invention.

The method of reducing a band mark on an electroplating steel sheet according to the present invention is described as below with references to the attached figures.

The present invention comprises ceramic coating portions of circular bands, placed respectively in a thin strip at the both edge regions of the metal band portion (10) at the central portion of a conductor roll (1). At the outer side of said ceramic coating portion (20), there is a conventional rubber section (30). The width of a ceramic coating portion (20) is approximately more than 10 mm, or more preferably, lesser than the width of the electroplating steel sheet (S) by approximately 10 mm.

In other words, if the length of the metal band portion (10) is x mm, and the width of the plating steel sheet (S) is y mm, the ceramic coating portion (20) should be coated with a width (d) between (x+10) mm at minimum and (y−10) mm at maximum.

According to the aforementioned method, if there is no level difference between the conductive metal band portion (1) and the nonconductive ceramic coating portion (20) at room temperature, the level difference does not occur even at the temperature in use (approximately 70° C.). Further, since the two elasticity coefficients are similar, the level difference does not occur due to the pressing by the plating steel sheet. Accordingly, in such cases, static electricity does not occur, and neither does a band mark.

Although there is a level difference at a certain height as between the ceramic coating portion (2) and the rubber section (30), the generation of static electricity is prevented at the source in such circumstances by reducing the level difference as compared to that of the prior art.

In other words, if the level difference of a ceramic coating portion (20) is made in such a way to be slightly higher or at flush with the rubber section (30), the load of the plating steel sheet (S) becomes concentrated onto the rubber section (30) having weak physical properties (i.e., lower elasticity coefficient), which results in a significant reduction of a band mark on a steel sheet. Further, by concentrating the load of the electroplating steel sheet (S) onto the rubber section, the weakness of the ceramic coating portion (20) is offset to the same extent, with the result of preventing damages to the ceramic coating portion.

If the width (d') of a ceramic coating portion (20) is less than 10 mm, there is a risk that a gap would form the space between the steel sheet (S) and the metal band portion (10) when the level difference (h) between the metal band portion (10) and the ceramic coating portion (20) is large. Through this type of a gap, static electricity would occur therein.

Moreover, if the gap between the ceramic coating portion (20) and the minimal width of a steel sheet is less than 10 mm, the seal between the rubber section (30) and the electroplating steel sheet (S) becomes incomplete, and the plating solution seeps through the gap, which in turn results in contamination of the plating steel sheet.

On the other hand, as for the coating method for the ceramic coating portion (20), the spray-coating method is used. It is preferable to carry out the coating by means of a plasma sprayer in order to minimize such conditions as post-coating separation.

Further, as for the coating materials for the ceramic coating portion (20), it is preferable to use oxide-based ceramics with not so good electric conductivity, such as alumina ($Al_2O_3$), zirconia ($ZrO_2$), and chromia ($Cr_2O_3$). In particular, as compared to electric non-conductivity of oxidized ceramics sintered at the same thickness, there is an improvement in electric non-conductivity of oxidized ceramics after spray-coating.

Approximately 3–40 wt % of titania ($TiO_2$) is added to the aforementioned coating material of a ceramic coating portion (i.e., alumina, zirconia, chromia). By adding more titania as such, the toughness of the coating material improves. As compared to pure zirconia, the zirconia used herein is a partially stabilized zirconia with a small amount of added MgO, $CeO_2$, $Y_2O_3$, etc.

As for the aforementioned material, which is in a form of powder, a comparatively fine powder should be used with a particle size of approximately 5~50 μm. Depending on the particle size of the powder in use, the porosity and roughness of the coating may vary, and by using fine powder, the porosity and roughness can be lowered to the maximum.

Moreover, since there are approximately 5~10% of micropores still remaining on the ceramic coating even after lowering the porosity, a sealing treatment is carried out with a material (e.g., urethane or epoxy), which can tolerate the acidic plating solution at the temperature in use. There, only if the plating solution does not seep trough the coating layer, can it prevent contamination of a plating steel sheet, even after replacing the plating solution.

Preferably, the thickness of the ceramic coating portion (20) should be 0.2~2 mm. If the thickness of the ceramic coating portion (20) as coated is 0.2 mm or less, it becomes easily worn out due to the deterioration of electric non-conductivity, which in turn results in inconvenience of re-coating work within a short period of time. On the other hand, if the thickness as coated is 2 mm or more, it is characterized by deterioration of wear resistance with easy cracking due to the deterioration of bonding force of the coating layer.

As for the ceramic spray-coating, there is a deterioration of bonding force in the case of direct coating with the metals such as steel. Accordingly, in using the method of spray-coating, the metal coating is first carried out, followed by ceramic spray-coating. As for spray-coating the metals, it is preferable to coat it by using a plasma or high-speed sprayer.

Meanwhile, by using the same coating material as the metal material used in the metal band portion (10), the differences in the thermal expansion coefficients can be minimized, with the result of preventing separation and extending the life of the coating.

For the following reasons, it is preferable to set the thickness of the metal coating at 50~200 μm. If the thickness of the coating is 50 μm or less, the effect of the metal-bonded coating layer becomes insignificant. If the thickness of the coating is 200 μm or more, there is a decline in economical efficiency.

BEST MODE FOR CARRYING OUT THE INVENTION

In the simulator tester, hastelloy (H) was used as a material for the metal band portion (10) of a conductor roll (1), and multilastic (M) was used as a material for the rubber section (30). With respect to the ceramic coating portion (20) after spray-coating according to the present invention, the degree of formation of a band mark on a plating steel sheet was measured by using a gloss measurement device.

Meanwhile, the length of the metal band portion (10) using hastelloy was 700 mm, and the minimal width of a plating steel sheet (S) was 800 mm. As for the spray-coating on the ceramic coating portion (20), the test was carried out with its width of 25 mm.

As for the coating material of the ceramic coating portion (20), the material of $Al_2O_3$-13% $TiO_2$ was used. There, the powder with a particle size of 5-30 μm was used to coat the ceramic coating portion (20) by means of using a plasma sprayer. The metal-bonded coating layer was coated with a hastelloy material by means of using a high-speed sprayer.

Figure 4A:
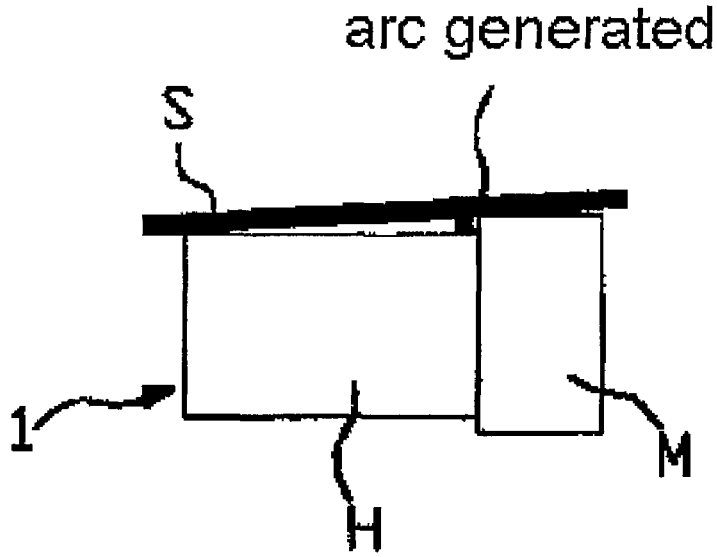
FIGS. 4(*a*) and 4(*b*) are structural diagrams, which compare the embodiment of prior art with that of the present invention.
Figure 4B:
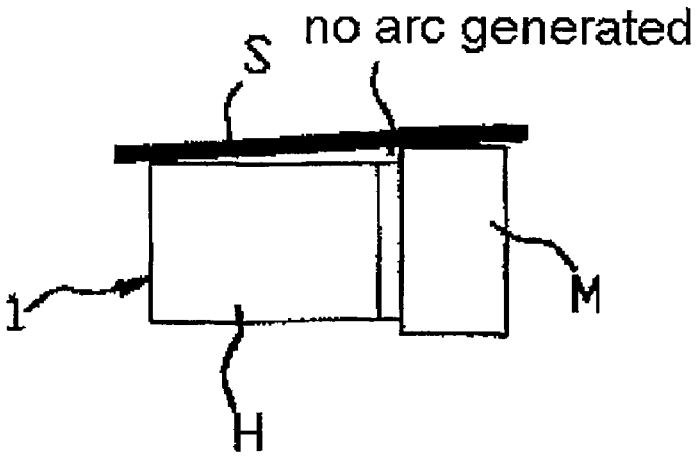

As typically shown in FIG. 4, the metal-bonded coating layer was finished off at a thickness of approximately 100 μm, and the ceramic coating layer at approximately 600 μm. After spray-coating, a commercially sold sealing agent was sprayed thereto. Then, after the abrasion work, the testing was carried out with respect to the plating steel sheets.

In the prior art, if the multilastic material is on top of the hastelloy material during the process of using a conductor roll (1), it generates static electricity. As such, under the condition of hastelloy being on top, the level difference as between hastelloy and multilastic was set to equal 0.4 mm.

In the present invention, it was made without any level difference between the hastelloy and the multilastic. With the multilastic material on top of the ceramic coating, the level difference was set to 0.1 mm.

TABLE 1

Measurement of the Degree of Band Mark Formation

| | Scores on the Band Marks | | | | | |
|---|---|---|---|---|---|---|
| Type of Plating Steel Sheet | A | B | C | D | E | F |
| Prior Art | 4.1 | 4.1 | 3.5 | 4.2 | 3.8 | 4.3 |
| Present Invention | 1.0 | 0.9 | 0.8 | 0.4 | 0.1 | 0.2 |

Table 1 shows the scores on the band marks according to the respective plating steel sheets and the thickness thereof in the simulator tester. As shown in Table 1, the higher the scores on the band marks, the more severe the band marks became with exasperating differences from the normal sections.

In the present invention, it showed a significant reduction of a band mark, even to the degree of posing difficulties in identification with the naked eye. Furthermore, there were no problems associated with occurrence of static electricity during its use. While the rubber material was easily worn out during the abrasion work on a conventional roll, the problem was effectively solved by preventing such premature wearing-out by means of ceramic coating, with the effect of extending the life of a roll.

INDUSTRIAL APPLICABILITY

According to the method of reducing a band mark on an electroplating steel sheet according to the present invention, it prevents generation of static electricity by minimizing the level difference between the conductive material (metal band portion) and the non-conductive material (rubber section). In this manner, the frequency of occurrence of band marks on plating steel sheets is reduced. Moreover, the present invention has the effects of enhancing wear and corrosion resistances, which in turn results in extending the life of a plating apparatus.

The invention claimed is:

1. A conductor roll for electroplating steel sheets, comprising:

a central portion with a metal-containing surface;

intermediate portions with a ceramic surface; and end portions with a rubber surface.

2. The conductor roll of claim 1, wherein the ceramic surface comprises ceramic oxide materials.

3. The conductor roll of claim 2, wherein the ceramic oxide comprises alumina, zirconia, chromia, or a combination thereof.

4. The conductor roll of claim 3, wherein the ceramic oxide further comprises titania.

5. The conductor roll of claim 3, wherein the zirconia further contains MgO, $CeO_2$, $Y_2O_3$, or a combination thereof.

6. The conductor roll of claim 1, wherein the width of the intermediate portions is greater than 10 mm.

7. The conductor roll of claim 1, further comprising a seal over the ceramic surface.

8. The conductor roll of claim 1, wherein the intermediate portion comprises a metal-containing substrate with a ceramic coating having a thickness ranging from about 0.2 mm to about 2 μmm.

9. An electroplating system containing a conductor roll comprising:

a central portion with a metal-containing surface;

intermediate portions with a ceramic surface; and end portions with a rubber surface.

10. The system of claim 9, wherein the intermediate portion comprises a metal-containing substrate with a ceramic coating.

11. The system of claim 9, further comprising a seal over the ceramic surface.

12. A method for making a conductor roll for electroplating steel sheets, comprising:

providing a central portion with a metal-containing surface;

providing intermediate portions with a ceramic surface; and providing end portions with a rubber surface.

13. The method of claim 12, wherein the intermediate portion comprises a metal-containing substrate with a ceramic coating.

14. The method of claim 13, including providing the ceramic coating on the metal-containing substrate by spray coating a ceramic-oxide material on the substrate.

15. The method of claim 14, further including spray coating by using plasma spray-coating.

16. The method of claim 14, including spray coating for a time sufficient to form a coating with thickness ranging from about 0.2 to about 2 mm.

17. The method of claim 14, including spray coating over an area of the metal-containing substrate to form a coating with a width greater than about 10 mm.

18. The method of claim 13, further including spray coating a metal coating on the metal-containing substrate before providing the ceramic coating.

19. The method of claim 18, wherein the metal of the metal coating and the metal-containing substrate are the same.

20. The method of claim 12, further including providing a seal over the ceramic surface.

21. A method for using a conductor roll, comprising:

providing a conductor roll having a central portion with a metal-containing surface, intermediate portions with a ceramic surface, and end portions with a rubber surface;

immersing the conductor roll in a plating solution; and rolling a stainless steel sheet over the conductor roll.

22. The method of claim 21, wherein the method electroplates a material in the plating solution on the stainless steel sheet.

* * * * *

UNITED STATES PATENT AND TRADEMARK OFFICE

CERTIFICATE OF CORRECTION

PATENT NO. : 7,045,043 B1
APPLICATION NO. : 10/089125
DATED : May 16, 2006
INVENTOR(S) : Hyung-Jun Kim It is certified that error appears in the above-identified patent and that said Letters Patent is hereby corrected as shown below:

Column 6, Line 36, Claim 8, change "0.2 mm to about 2 umm." to -- 0.2 mm to about 2 mm.

Signed and Sealed this

Fifteenth Day of August, 2006

JON W. DUDAS
*Director of the United States Patent and Trademark Office*